US011248594B2

(12) United States Patent
Noh et al.

(10) Patent No.: US 11,248,594 B2
(45) Date of Patent: Feb. 15, 2022

(54) LINEAR COMPRESSOR

(71) Applicant: LG Electronics Inc., Seoul (KR)

(72) Inventors: Kiwon Noh, Seoul (KR); Kyunyoung Lee, Seoul (KR); Youngmun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/836,039

(22) Filed: Mar. 31, 2020

(65) Prior Publication Data

US 2021/0054832 A1 Feb. 25, 2021

(30) Foreign Application Priority Data

Aug. 23, 2019 (KR) ..... 10-2019-0103624

(51) Int. Cl.

| | |
|---|---|
| ***F04B 35/04*** | (2006.01) |
| ***F04B 39/00*** | (2006.01) |
| ***F25B 31/02*** | (2006.01) |
| ***F25B 1/02*** | (2006.01) |

(52) U.S. Cl.

CPC ..... *F04B 35/045* (2013.01); *F04B 35/04* (2013.01); *F04B 39/0072* (2013.01); *F25B 1/02* (2013.01); *F25B 31/023* (2013.01); *F04B 39/0005* (2013.01); *F04B 39/0061* (2013.01); *F25B 2309/001* (2013.01); *F25B 2400/073* (2013.01)

(58) Field of Classification Search

CPC .... F04B 35/04; F04B 35/045; F04B 39/0005; F04B 39/0061; F04B 39/0072; F25B 1/02; F25B 2400/073; F25B 2309/001; F25B 31/023

See application file for complete search history.

(56) References Cited

U.S. PATENT DOCUMENTS

| | | | | |
|---|---|---|---|---|
| 5,947,708 | A * | 9/1999 | Park | A61P 29/00 417/552 |
| 5,993,178 | A * | 11/1999 | Park | F04B 35/045 417/416 |
| 7,306,438 | B2 * | 12/2007 | Kang | F04B 35/045 181/229 |
| 8,366,415 | B2 * | 2/2013 | Kang | F04B 35/045 417/416 |
| 9,353,773 | B2 * | 5/2016 | Lilie | F15B 15/00 |

(Continued)

FOREIGN PATENT DOCUMENTS

| | | |
|---|---|---|
| EP | 2977611 | 1/2016 |
| EP | 3196460 | 7/2017 |

(Continued)

OTHER PUBLICATIONS

Extended European Search Report in European Appln. No. 20168648.2, dated Sep. 14, 2020, 4 pages.

(Continued)

*Primary Examiner* — Christopher S Bobish

(74) *Attorney, Agent, or Firm* — Fish & Richardson P.C.

(57) ABSTRACT

The present disclosure relates to a linear compressor. The linear compressor according to an aspect of the present disclosure includes a shell, a cylinder, a piston, and a muffler. Also, an internal space in which at least a portion of the muffler is inserted is formed in the piston, and the muffler is disposed in contact with the inner wall of the piston forming the internal space.

18 Claims, 12 Drawing Sheets

(56) References Cited

U.S. PATENT DOCUMENTS

| | | | | |
|---|---|---|---|---|
| 9,989,051 | B2 * | 6/2018 | Noh | F04B 53/1022 |
| 10,012,222 | B2 * | 7/2018 | Lilie | F04B 17/04 |
| 10,890,168 | B2 * | 1/2021 | Bae | F04B 39/0066 |
| 10,927,828 | B2 * | 2/2021 | Kim | F04B 35/045 |

FOREIGN PATENT DOCUMENTS

| | | |
|---|---|---|
| EP | 3511571 | 7/2017 |
| KR | 10-0579578 | 5/2006 |
| KR | 20070073515 | 8/2007 |
| KR | 20190031048 | 3/2019 |
| KR | 1020190038085 | 6/2019 |

OTHER PUBLICATIONS

Korean Office Action in Korean Appln. No. 10-2019-0103624, dated May 27, 2020, 11 pages (with English translation).

* cited by examiner

LINEAR COMPRESSOR

CROSS REFERENCE TO RELATED APPLICATION

The present application claims priority to Korean Patent Application No. 10-2019-0103624, filed on Aug. 23, 2019, the entire contents of which is incorporated herein for all purposes by this reference.

TECHNICAL FIELD

The present disclosure relates to a linear compressor.

BACKGROUND

In general, a compressor, which is a mechanical apparatus that increases the pressure of air, a refrigerant, or other various working fluids by compressing them using power from a power generator such as an electric motor or a turbine, is generally used not only for home appliances, such as a refrigerator, but also throughout the industry.

Such compressor is classified into a reciprocating compressor, a rotary compressor, and a scroll compressor in accordance with the type of compressing working fluid.

In detail, the reciprocating compressor includes a cylinder and a piston that is disposed to be able to reciprocate straight in the cylinder. In this case, a compression space is formed between a piston head and the cylinder, and as the piston reciprocates straight, the compression space increases or decreases and working fluid in the compression space is compressed at high temperature and high pressure.

Further, the rotary compressor includes a cylinder and a roller eccentrically rotating in the cylinder. In this case, as the roller eccentrically rotates in the cylinder, working fluid supplied in a compression space is compressed at high temperature and high pressure.

Further, the scroll compressor includes a fixed scroll and rotary scroll rotating about the fixed scroll. In this case, as the rotary scroll rotates, working fluid supplied in a compression space is compressed at high temperature and high pressure.

Recently, in the reciprocating compressor, a linear compressor in which a piston is directly connected to a linear motor reciprocating straight has been actively developed.

The linear compressor includes a linear motor that reciprocates straight a piston. The linear motor is configured such that a permanent magnet is positioned between an inner stator and an outer stator, and the permanent magnet is reciprocated straight by interactive electromagnetic force between the permanent magnet and the inner (or outer) stator. Further, as operation is performed with the permanent magnet connected to the piston, the piston can reciprocate.

The piston suctions and compresses a refrigerant while reciprocating straight in the cylinder in a closed shell. In detail, a refrigerant is suctioned into a compression chamber when the piston moves from the top dead center to the bottom dead center, and the refrigerant in the compression chamber is compressed when the piston moves from the bottom dead center to the top dead center. In this case, the higher the pressure of the suctioned gas flowing to the piston, the more the intake valve quickly opens and the more the refrigerant can be supplied into the compression chamber.

In relation to a linear compressor having this configuration, the applicant(s) has filed a patent application (hereafter, patent document 1), which was registered.

<Prior Art Document 1>

1. Registration No.: 10-0579578 (Registration date: May 8, 2006)

2. Title of invention: Muffler of linear compressor

A muffler disposed in a piston is disclosed in Prior Art Document 1. The muffler reduces noise due to flow of a refrigerant and functions as a path through which a refrigerant suctioned into a compressor moves to a piston.

According to the shape of the muffler disclosed in Prior Art Document 1, the pressure of suctioned gas flowing to the piston along the muffler is relative low. When the pressure of the suctioned gas decreases, there is a problem that the refrigerant that is received in the compression chamber is insufficient or the refrigerant flows backward to the piston from the compression chamber.

Further, since the refrigerant flows backward to the piston from the compression chamber or the heat of the refrigerant transfers to the piston, so the temperature of the piston may relatively increase. Further, when the refrigerant that is suctioned flows to the inner wall of the piston, there is a problem that compression efficiency is deteriorated by overheating.

SUMMARY

The present disclosure has been made in an effort to solve these problems and an object of the present invention is to provide a linear compressor including a muffler that prevents overheating due to contact of a suctioned refrigerant with a piston.

Another object of the present invention is to provide a linear compressor including a muffler that can be changed in various shapes.

Another object of the present invention is to provide a linear compressor that prevents overheating of a refrigerant that is suctioned, and having high cooling ability and efficiency by decreasing the temperature of a piston using the refrigerant in a shell.

The present disclosure is characterized in that a refrigerant suctioned through a suction pipe flows to a compression space without coming in contact with the inner wall of a piston. In particular, since a muffler is in close contact with the inner wall of the piston, the suctioned refrigerant may not come in contact with the inner wall of the piston while flowing through the muffler.

A linear compressor according to an aspect of the present disclosure includes: a shell to which a suction pipe is coupled; a cylinder disposed in the shell and having a compression space; a piston disposed to be able to axially reciprocate in the cylinder to compress a refrigerant in the compression space; and a muffler providing a refrigerant suctioned through the suction pipe into the compression space.

An internal space in which at least a portion of the muffler is inserted and disposed is formed in the piston.

Also, the muffler is disposed in contact with an inner wall of the piston that forms the internal space.

By this structure, it is possible to prevent a refrigerant suctioned through the suction pipe from flowing to the inner wall of the piston.

A linear compressor according to an embodiment of the present disclosure includes: a shell to which a suction pipe is coupled; a cylinder disposed in the shell and having a compression space; a piston disposed to be able to axially reciprocate in the cylinder to compress a refrigerant in the compression space; and a muffler providing a refrigerant suctioned through the suction pipe into the compression space.

Also, an internal space in which at least a portion of the muffler is inserted is formed in the piston, and the muffler may be disposed in contact with the inner wall of the piston forming the internal space.

The internal space may be formed by a first inner wall forming a side wall of the piston and a second inner wall in which an inlet end of a suction channel communicating with the compression space is formed, and the muffler may be disposed in contact with the second inner wall.

The muffler may have an axial front end that is in contact with the second inner wall to prevent the refrigerant suctioned through the suction pipe from flowing to the first inner wall.

The axial front end of the muffler may have an outer diameter corresponding to an outer diameter of the second inner wall and may be formed in a ring shape.

The axial front end of the muffler may be configured to have a circular shape corresponding to the second inner wall and may have a suction opening corresponding to the inlet end of the suction channel.

A sealing member preventing leakage of a refrigerant may be disposed between the axial front end of the muffler and the second inner wall.

The muffler may include a muffler case extending along the first inner wall to prevent the refrigerant suctioned through the suction pipe from flowing to the first inner wall.

A flow opening formed such that a refrigerant in the shell flows between the muffler case and the first inner wall may be formed in the muffler.

The flow opening may be formed as several pieces and the several flow openings may be circumferentially formed at an outside of an axial rear end of the muffler case.

A flow space formed between the muffler and the inner wall of the piston such that a refrigerant in the shell flows may be included in the internal space.

A first space in which the refrigerant suctioned through the suction pipe flows may be formed radially inside the muffler inserted and disposed in the piston, and a second space in which a refrigerant in the shell flows may be formed radially outside the muffler.

The muffler may include: a first muffler disposed in the internal space; and second and third mufflers disposed axially behind the piston and coupled to the first muffler, and the first muffler may include a muffler case axially extending along the inner wall of the piston.

The first muffler may include a flow pipe spaced radially inward apart from the muffler case and axially extending.

The muffler case may axially extend further than the flow pipe to be in contact with the inner wall of the piston.

The flow pipe may be formed such that an outer diameter thereof gradually increases in a flow direction of a suctioned refrigerant suctioned through the suction pipe and flowing toward the compression space.

A linear compressor according to another aspect includes: a shell to which a suction pipe is coupled; a cylinder disposed in the shell and having a compression space; a piston disposed to be able to axially reciprocate in the cylinder to compress a refrigerant in the compression space; and a muffler providing a refrigerant suctioned through the suction pipe into the compression space.

The piston may include a first inner wall forming an internal space in which at least a portion of the muffler is inserted and disposed, and the muffler may include a muffler case extending along the first inner wall to prevent the refrigerant suctioned through the suction pipe from flowing to the first inner wall.

A flow space formed between the muffler case and the first inner wall of the piston such that a refrigerant in the shell flows may be included in the internal space.

A first space in which the refrigerant suctioned through the suction pipe flows may be formed radially inside the muffler case, and a second space in which a refrigerant in the shell flows may be formed radially outside.

The muffler may further include a flow pipe spaced radially inward apart from the muffler case and allowing a suctioned refrigerant suctioned through the suction pipe to flow therethrough.

The internal space may be separated into two spaces in which refrigerants having different properties flow by the muffler case.

According to the present disclosure, since the refrigerant suctioned through the suction pipe flows to the compression space without coming in contact with the inner wall of the piston, there is an advantage that the suctioned refrigerant cannot be influenced by the piston.

Accordingly, there is an advantage that the amount of heat transferring the suctioned refrigerant can be reduced, the temperature and pressure of the suctioned refrigerant can be decreased, and the compression efficiency is increased.

Also, since the flow of the suctioned refrigerant is guided by the muffler, there is an advantage that unnecessary flow is reduced and a loss of flow can be decreased.

Also, there is an advantage that the heat of the piston can be reduced by the refrigerant in the shell and the heat transferring to the suctioned refrigerant can be more effectively reduced.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION

Figure 1:
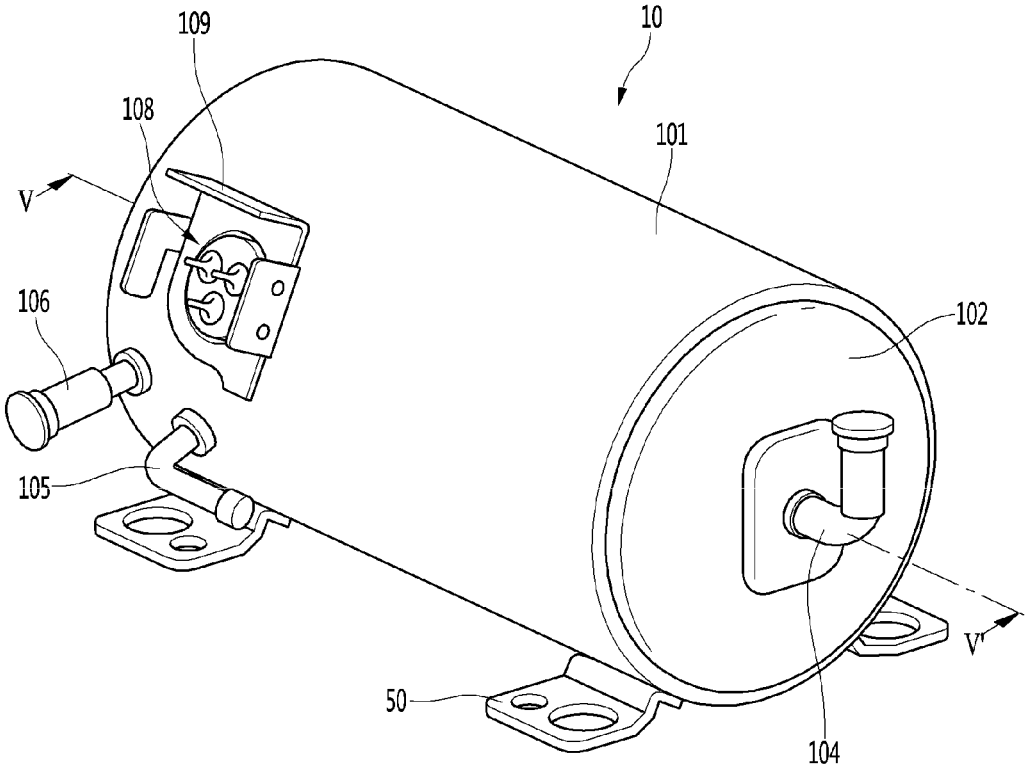
FIG. 1 is a view showing the external appearance of a linear compressor according to an embodiment of the present disclosure.

Hereinafter, embodiments of the present disclosure are described in detail with reference to exemplary drawings. It should be noted that when components are given reference numerals in the drawings, the same components are given the same reference numerals even if they are shown in different drawings. Further, in the following description of embodiments of the present invention, when detailed description of well-known configurations or functions is determined as interfering with understanding of the embodiments of the present invention, they are not described in detail.

Further, terms 'first', 'second', 'A', 'B', '(a)', and '(b)' can be used in the following description of the components of embodiments of the present invention. The terms are provided only for discriminating components from other components and, the essence, sequence, or order of the components are not limited by the terms. When a component is described as being "connected", "combined", or "coupled" with another component, it should be understood that the component may be connected or coupled to another component directly or with another component interposing therebetween.

Figure 2:
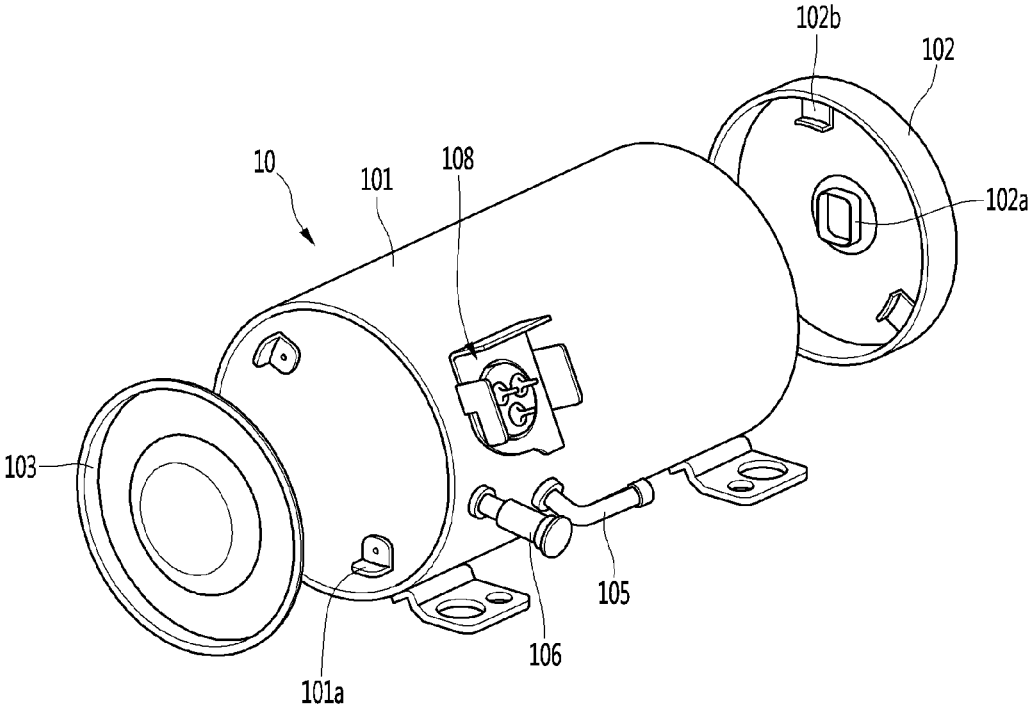
FIG. 2 is a view showing the linear compressor according to an embodiment of the present disclosure with a shell and a shell cover separated.

FIG. 1 is a view showing the external appearance of a compressor according to an embodiment of the present disclosure and FIG. 2 is a view showing the compressor according to an embodiment of the present disclosure with a shell and a shell cover separated.

Referring to FIGS. 1 and 2, a linear compressor 10 according to an embodiment includes a shell 101 and shell covers 102 and 103 coupled to the shell 101. In a broad sense, the shell covers 102 and 103 may be understood as components of the shell 101.

A leg 50 may be coupled to a lower portion of the shell 101. The leg 50 may be coupled to a base of a product in which the linear compressor 10 is installed. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, since the linear compressor 10 has a low height, when the linear compressor 10 is installed in the machine room base of the refrigerator, a machine room may be reduced in height.

A terminal 108 may be installed on an outer surface of the shell 101. The terminal 108 may be understood as a component for transmitting external power to a motor assembly (see reference numeral 140 of FIG. 4) of the linear compressor 10. The terminal 108 may be connected to a lead line of a coil (see reference numeral 141*c* of FIG. 4).

A bracket 109 is installed outside the terminal 108. The bracket 109 may include a plurality of brackets surrounding the terminal 108. The bracket 109 may protect the terminal 108 against an external impact.

Both sides of the shell 101 may be opened. The shell covers 102 and 103 may be coupled to both opened sides of the shell 101. In detail, the shell covers 102 and 103 includes a first shell cover 102 coupled to one opened side of the shell 101 and a second shell cover 103 coupled to the other opened side of the shell 101. An inner space of the shell 101 may be sealed by the shell covers 102 and 103.

In FIG. 1, the first shell cover 102 may be disposed at a right portion of the linear compressor 10, and the second shell cover 103 may be disposed at a left portion of the linear compressor 10. That is to say, the first and second shell covers 102 and 103 may be disposed to face each other.

The linear compressor 10 further includes a plurality of pipes 104, 105, and 106 provided in the shell 101 or the shell covers 102 and 103 to suction, discharge, or inject the refrigerant.

The plurality of pipes 104, 105, and 106 include a suction pipe 104 through which the refrigerant is suctioned into the linear compressor 10, a discharge pipe 105 through which the compressed refrigerant is discharged from the linear compressor 10, and a process pipe 106 through which the refrigerant is supplemented to the linear compressor 10.

For example, the suction pipe 104 may be coupled to the first shell cover 102. The refrigerant may be suctioned into the linear compressor 10 through the suction pipe 104 in an axial direction.

The discharge pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be disposed at a position that is adjacent to the second shell cover 103 rather than the first shell cover 102.

The process pipe 106 may be coupled to an outer circumferential surface of the shell 101. A worker may inject the refrigerant into the linear compressor 10 through the process pipe 106.

The process pipe 106 may be coupled to the shell 101 at a height different from that of the discharge pipe 105 to avoid interference with the discharge pipe 105. The height is understood as a distance from the leg 50 in the vertical direction (or the radial direction). Since the discharge pipe 105 and the process pipe 106 are coupled to the outer circumferential surface of the shell 101 at the heights different from each other, worker's work convenience may be improved.

At least a portion of the second shell cover 103 may be disposed adjacent to the inner circumferential surface of the shell 101, which corresponds to a point to which the process pipe 106 is coupled. That is to say, at least a portion of the second shell cover 103 may act as flow resistance of the refrigerant injected through the process pipe 106.

Thus, in view of the passage of the refrigerant, the passage of the refrigerant introduced through the process pipe 106 may have a size that gradually decreases toward the inner space of the shell 101. In this process, a pressure of the refrigerant may be reduced to allow the refrigerant to be vaporized. Also, in this process, oil contained in the refrigerant may be separated. Thus, the refrigerant from which the oil is separated may be introduced into the piston 130 to improve compression performance of the refrigerant. The oil may be understood as working oil existing in a cooling system.

A cover support part 102*a* is disposed on an inner surface of the first shell cover 102. A second support device 185 that will be described later may be coupled to the cover support part 102*a*. The cover support part 102*a* and the second support device 185 may be understood as devices for supporting a main body of the linear compressor 10. Here, the main body of the compressor represents a part provided in the shell 101. For example, the main body may include a driving part that reciprocates forward and backward and a support part supporting the driving part. The driving part may include parts such as the piston 130, a magnet frame 138, a permanent magnet 146, a support 137, and a suction muffler 200. Also, the support part may include parts such as resonant springs 176*a* and 176*b*, a rear cover 170, a stator cover 149, a first support device 165, and a second support device 185.

A stopper 102*b* may be disposed on the inner surface of the first shell cover 102. The stopper 102*b* may be understood as a component for preventing the main body of the compressor, particularly, the motor assembly 140 from being bumped by the shell 101 and thus damaged due to the vibration or the impact occurring during the transportation of the linear compressor 10. The stopper 102*b* may be disposed adjacent to the rear cover 170 that will be described later. Thus, when the linear compressor 10 is shaken, the rear cover 170 may interfere with the stopper 102*b* to prevent the impact from being transmitted to the motor assembly 140.

A spring coupling part 101*a* may be disposed on the inner surface of the shell 101. For example, the spring coupling part 101*a* may be disposed at a position that is adjacent to the second shell cover 103. The spring coupling part 101*a* may be coupled to a first support spring 166 of the first support device 165 that will be described later. Since the spring coupling part 101*a* and the first support device 165 are coupled to each other, the main body of the compressor may be stably supported inside the shell 101.

Figure 3:
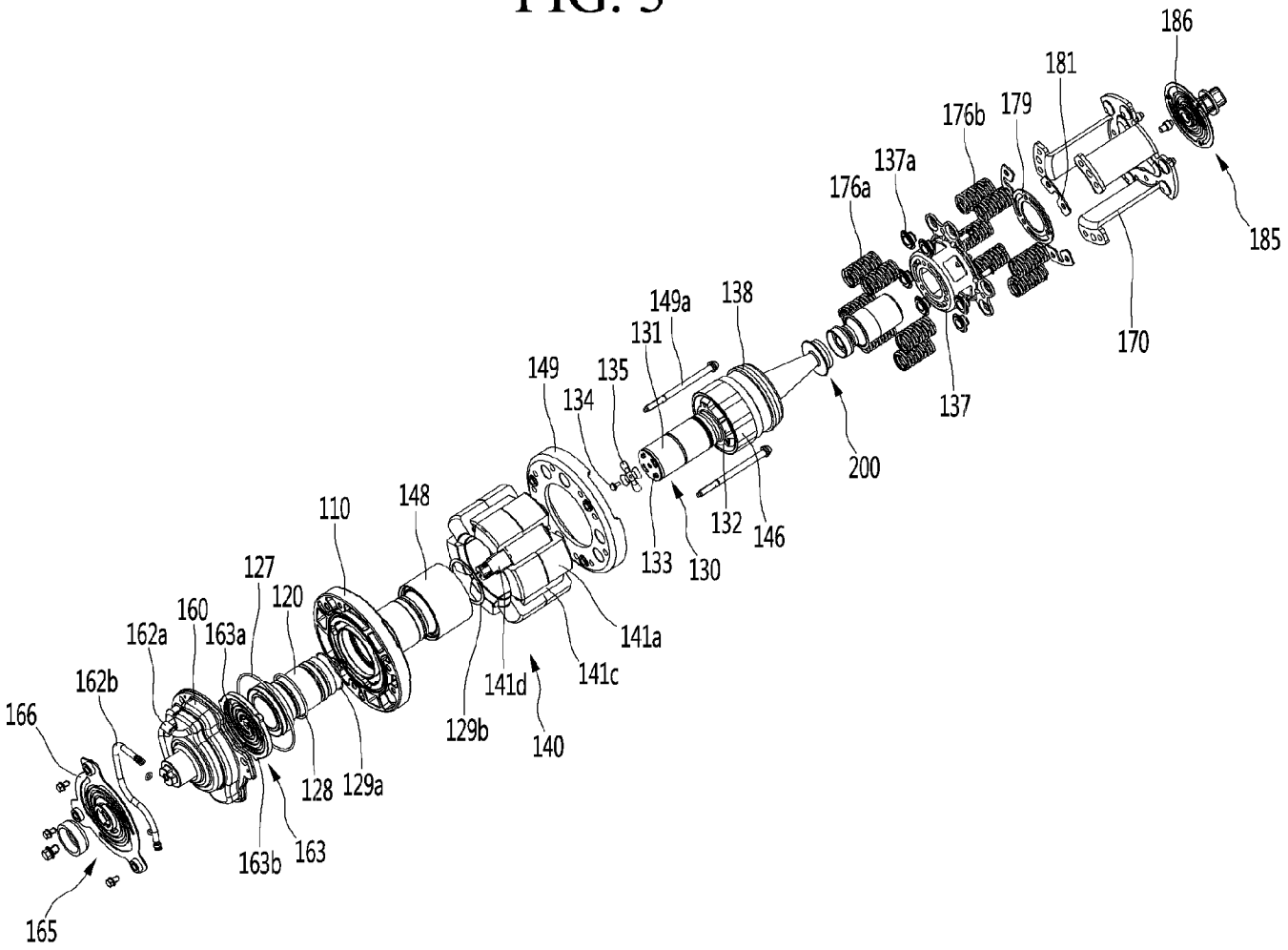
FIG. 3 is an exploded perspective view illustrating internal parts of the linear compressor according to an embodiment.
Figure 4:
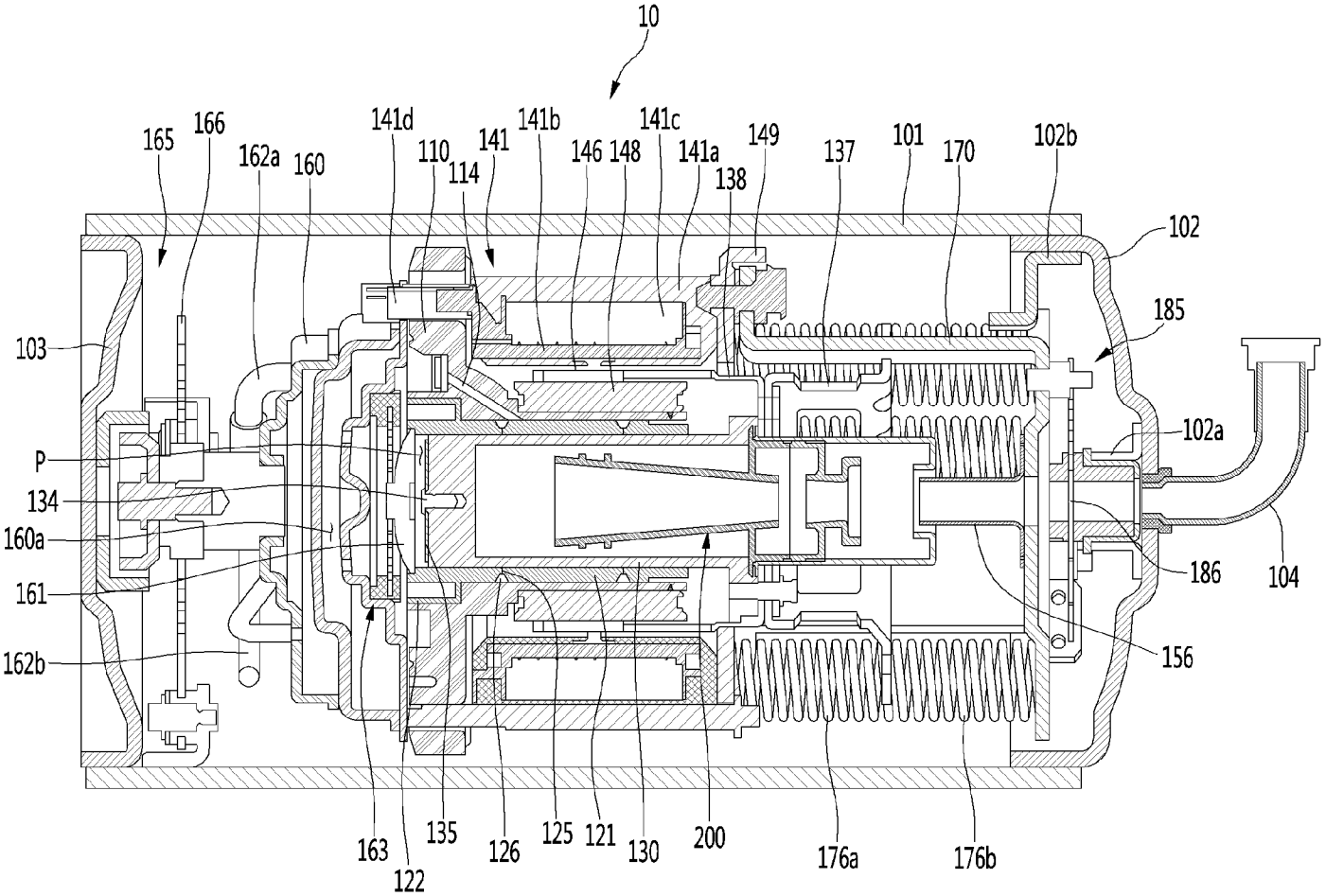
FIG. 4 is a cross-sectional view illustrating the internal parts of the linear compressor according to an embodiment.

FIG. 3 is an exploded perspective view illustrating internal parts of the linear compressor according to an embodiment, and FIG. 4 is a cross-sectional view illustrating the internal parts of the linear compressor according to an embodiment.

Referring to FIGS. 3 and 4, the linear compressor 10 according to an embodiment includes a cylinder 120 provided in the shell 101, a piston 130 that linearly reciprocates within the cylinder 120, and a motor assembly 140 that functions as a linear motor for applying driving force to the piston 130. When the motor assembly 140 is driven, the piston 130 may linearly reciprocate in the axial direction.

The linear compressor 10 further includes the suction muffler 200 coupled to the piston 130 to reduce a noise generated from the refrigerant suctioned through the suction pipe 104. The refrigerant suctioned through the suction pipe 104 flows into the piston 130 via the muffler 200.

For example, while the refrigerant passes through the muffler 200, the flow noise of the refrigerant may be reduced. Further, the muffler 200 is provided in various shapes and may adjust the pressure of the refrigerant passing through the muffler 200. Various shapes of the muffler will be described in detail below.

Directions are defined as follows.

The "axial direction" may be understood as a direction in which the piston 130 reciprocates, i.e., the horizontal direction in FIG. 4. Also, in the axial direction", a direction from the suction pipe 104 toward a compression space P, i.e., a direction in which the refrigerant flows may be defined as a "front direction", and a direction opposite to the front direction may be defined as a "rear direction". When the piston 130 moves forward, the compression space P may be compressed.

On the other hand, the "radial direction" may be understood as a direction that is perpendicular to the direction in which the piston 130 reciprocates, i.e., the vertical direction in FIG. 4.

The piston 130 includes a piston body 131 having an approximately cylindrical shape and a piston flange part 132 extending from the piston body 131 in the radial direction. The piston body 131 may reciprocate inside the cylinder 120, and the piston flange part 132 may reciprocate outside the cylinder 120.

The cylinder 120 is configured to accommodate at least a portion of the muffler 200 and at least a portion of the piston body 131.

The cylinder 120 has the compression space P in which the refrigerant is compressed by the piston 130. Also, a suction hole 133 through which the refrigerant is introduced into the compression space P is defined in a front portion of the piston body 131, and a suction valve 135 for selectively opening the suction hole 133 is disposed on a front side of the suction hole 133. A coupling hole to which a predetermined coupling member 134 is coupled is defined in an approximately central portion of the suction valve 135.

Further, the compressor includes a discharge cover 160 and a discharge valve assembly 161 and 163. The discharge cover 160 is installed ahead of the compression space P, thereby forming a discharge space 160*a* for the refrigerant discharged from the compression space P. The discharge space 160*a* includes a plurality of space parts divided by the inner wall of the discharge cover 160. The plurality of space parts are disposed in a front and rear direction to communicate with each other.

The discharge valve assembly 161 and 163 is coupled to the discharge cover and selectively discharges the refrigerant compressed in the compression space P. The discharge valve assembly 161 and 163 includes a discharge valve 161 that is opened when the pressure of the compression space P is above a discharge pressure to introduce the refrigerant into the discharge space and a spring assembly 163 disposed between the discharge valve 161 and the discharge cover 160 to provide elastic force in the axial direction.

The spring assembly 163 includes a valve spring 163*a* and a spring support part 163*b* for supporting the valve spring 163*a* to the discharge cover 160. For example, the valve spring 163*a* may include a plate spring. The spring support part 163*b* may be integrally formed with the valve spring 163*a* by injection molding.

The discharge valve 161 is coupled to the valve spring 163*a*, and a rear portion or rear surface of the discharge valve 161 is disposed to be supported on a front surface of the cylinder 120. When the discharge valve 161 is supported on the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

The compression space P may be understood as a space defined between the suction valve 135 and the discharge valve 161. Also, the suction valve 135 may be disposed on one side of the compression space P, and the discharge valve 161 may be disposed on the other side of the compression space P, i.e., an opposite side of the suction valve 135.

While the piston 130 linearly reciprocates within the cylinder 120, when the pressure of the compression space P is below the discharge pressure and a suction pressure, the suction valve 135 may be opened to suction the refrigerant into the compression space P.

On the other hand, when the pressure of the compression space P is above the suction pressure, the suction valve 135 may compress the refrigerant of the compression space P in a state in which the suction valve 135 is closed.

When the pressure of the compression space P is above the discharge pressure, the valve spring 163*a* may be deformed forward to open the discharge valve 161. Here, the refrigerant may be discharged from the compression space P into the discharge space of the discharge cover 160. When the discharge of the refrigerant is completed, the valve spring 163*a* may provide restoring force to the discharge valve 161 to close the discharge valve 161.

The linear compressor 10 further includes a cover pipe 162*a* coupled to the discharge cover 160 to discharge the refrigerant flowing through the discharge space of the discharge cover 160. For example, the cover pipe 162*a* may be made of a metal material.

Also, the linear compressor 10 further includes a loop pipe 162*b* coupled to the cover pipe 162*a* to transfer the refrigerant flowing through the cover pipe 162*a* to the discharge pipe 105. The loop pipe 162*b* may have one side of the loop pipe 162*b* coupled to the cover pipe 162*a* and the other side coupled to the discharge pipe 105.

The loop pipe 162*b* may be made of a flexible material and have a relatively long length. Also, the loop pipe 162*b* may roundly extend from the cover pipe 162*a* along the inner circumferential surface of the shell 101 and be coupled to the discharge pipe 105. For example, the loop pipe 162*b* may have a wound shape.

The linear compressor 10 further includes a frame 110. The frame 110 is understood as a component for fixing the cylinder 120. For example, the cylinder 120 may be press-fitted into the frame 110. The cylinder 120 and the frame 110 may be made of aluminum or an aluminum alloy.

The frame 110 is disposed to surround the cylinder 120. That is, the cylinder 120 may be disposed to be accommodated into the frame 110. Also, the discharge cover 160 may be coupled to a front surface of the frame 110 by using a coupling member.

The motor assembly 140 includes an outer stator 141 fixed to the frame 110 and disposed to surround the cylinder 120, an inner stator 148 disposed to be spaced inward from the outer stator 141, and a permanent magnet 146 disposed in a space between the outer stator 141 and the inner stator 148.

The permanent magnet 146 may linearly reciprocate by mutual electromagnetic force between the outer stator 141 and the inner stator 148. Also, the permanent magnet 146 may be provided as a single magnet having one polarity or be provided by coupling a plurality of magnets having three polarities to each other.

The permanent magnet 146 may be installed on a magnet frame 138. The magnet frame 138 may have an approximately cylindrical shape and be disposed to be inserted into the space between the outer stator 141 and the inner stator 148.

In detail, referring to the cross-sectional view of FIG. 4, the magnet frame 138 may be coupled to the piston flange part 132 to extend in an outer radial direction and then be bent forward. The permanent magnet 146 may be installed on a front portion of the magnet frame 138. When the permanent magnet 146 reciprocates, the piston 130 may reciprocate together with the permanent magnet 146 in the axial direction.

The outer stator 141 includes coil winding bodies 141*b*, 141*c*, and 141*d* and a stator core 141*a*. The coil winding bodies 141*b*, 141*c*, and 141*d* include a bobbin 141*b* and a coil 141*c* wound in a circumferential direction of the bobbin 141*b*. The coil winding bodies 141*b*, 141*c*, and 141*d* further include a terminal part 141*d* that guides a power line connected to the coil 141*c* so that the power line is led out or exposed to the outside of the outer stator 141. The terminal part 141 may be disposed to be inserted in a terminal insertion part provided at the frame 110.

The stator core 141*a* includes a plurality of core blocks in which a plurality of laminations are laminated in a circumferential direction. The plurality of core blocks may be disposed to surround at least a portion of the coil winding bodies 141*b* and 141*c*.

A stator cover 149 may be disposed on one side of the outer stator 141. That is, the outer stator 141 may have one side supported by the frame 110 and the other side supported by the stator cover 149.

The stator cover 149 and the frame 110 are coupled by a cover coupling member 149*a*. The cover coupling member 149*a* may pass through the stator cover 149 to extend forward to the frame 110 and then be coupled to a coupling hole of the frame 110.

The inner stator 148 is fixed to a circumference of the frame 110. Also, in the inner stator 148, the plurality of laminations are laminated in the circumferential direction outside the frame 110.

The compressor 10 further includes a support 137 for supporting the piston 130. The support 137 may be coupled to a rear portion of the piston 130, and the muffler 200 may be disposed to pass through the inside of the support 137. The piston flange part 132, the magnet frame 138, and the support 137 may be coupled to each other by using a coupling member.

A balance weight 179 may be coupled to the support 137. A weight of the balance weight 179 may be determined based on a driving frequency range of the compressor body.

The linear compressor 10 further includes a rear cover 170 coupled to the stator cover 149 to extend backward and supported by the second support device 185.

In detail, the rear cover 170 includes three support legs, and the three support legs may be coupled to a rear surface of the stator cover 149. A spacer 181 may be disposed between the three support legs and the rear surface of the stator cover 149. A distance from the stator cover 149 to a rear end of the rear cover 170 may be determined by adjusting a thickness of the spacer 181. Also, the rear cover 170 may be spring-supported by the support 137.

The linear compressor 10 further includes an inflow guide part 156 coupled to the rear cover 170 to guide an inflow of the refrigerant into the muffler 200. At least a portion of the inflow guide part 156 may be inserted into the muffler 200.

The linear compressor 10 further include a plurality of resonant springs 176*a* and 176*b* that are adjusted in natural frequency to allow the piston 130 to perform a resonant motion.

The plurality of resonant springs 176*a* and 176*b* include a first resonant spring 176*a* supported between the support 137 and the stator cover 149 and a second resonant spring 176*b* supported between the support 137 and the rear cover 170. The driving part that reciprocates within the linear compressor 10 may stably move by the action of the plurality of resonant springs 176*a* and 176*b* to reduce the vibration or noise due to the movement of the driving part.

The support 137 includes a first spring support part 137*a* coupled to the first resonant spring 176*a*.

The linear compressor 10 includes a plurality of sealing members 127, 128, 129*a*, and 129*b* for increasing coupling force between the frame 110 and the peripheral parts around the frame 110. In detail, the plurality of sealing members 127, 128, 129*a*, and 129*b* include a first sealing member 127 disposed at a portion at which the frame 110 and the discharge cover 160 are coupled to each other. The first sealing member 127 may be disposed on a first installation groove of the frame 110.

The plurality of sealing members 127, 128, 129*a*, and 129*b* further include a second sealing member 128 disposed at a portion at which the frame 110 and the cylinder 120 are coupled to each other. The second sealing member 128 may be disposed on a second installation groove of the frame 110.

In detail, the plurality of sealing members 127, 128, 129*a*, and 129*b* further include a third sealing member 129*a* disposed between the cylinder 120 and the frame 110. The third sealing member 129*a* may be disposed on a cylinder groove defined in the rear portion of the cylinder 120. The third sealing member 129*a* can prevent a refrigerant in a gas pocket formed between the inner side of the frame and the outer side of the cylinder from leaking to the outside and can more firmly combining the frame 110 and the cylinder 120.

The plurality of sealing members 127, 128, 129*a*, and 129*b* further include a fourth sealing member 129*b* disposed at a portion at which the frame 110 and the inner stator 148 are coupled to each other. The fourth sealing member 129*b* may be disposed on a third installation groove of the frame 110. Each of the first to fourth sealing members 127, 128, 129*a*, and 129*b* may have a ring shape.

The linear compressor 10 further includes a first support device 165 coupled to a support coupling part of the discharge cover 160 to support one side of the main body of the compressor 10. The first support device 165 may be disposed adjacent to the second shell cover 103 to elastically support the main body of the compressor 10. In detail, the first retainer 165 includes a first support spring 166. The first support spring 166 may be coupled to the spring coupling part 101*a*.

The linear compressor 10 further includes a second support device 185 coupled to the rear cover 170 to support the other side of the main body of the compressor 10. The second support device 185 may be coupled to the first shell cover 102 to elastically support the main body of the compressor 10. In detail, the second support device 185 includes a second support spring 186. The second support spring 186 may be coupled to the cover support part 102*a*.

The cylinder 120 includes a cylinder body 121 axially extending and a cylinder flange 122 formed on the outer side of the front portion of the cylinder body 121. The cylinder body 121 is formed in a cylindrical shape having an axial center axis and is inserted in the frame 110. Accordingly, the outer side of the cylinder body 121 may be positioned to face the inner side of the frame 110.

A gas inlet 126 through which at least some of the refrigerant discharged through a discharge valve 161 flows inside is formed at the cylinder body 121. At least some of a refrigerant is understood as a refrigerant that is used as a gas bearing between the piston 130 and the cylinder 120.

The refrigerant that is used as a gas bearing, as shown in FIG. 4, flows to a gas pocket formed between the inner side of the frame 110 and the outer side of the cylinder 120 through a gas hole 114 formed at the frame 110. Also, the refrigerant in the gas pocket can flow to the gas inlet 126.

In detail, the gas inlet 126 may be radially recessed from the outer side of the cylinder body 121. The gas inlet 126 may be circumferentially formed around the outer side of the cylinder body 121 about the central axis. A plurality of gas inlets 126 may be provided. For example, two gas inlets 126 may be provided.

The cylinder body 121 includes a cylinder nozzle 125 extending radially inward from the gas inlet 126. The cylinder nozzle 125 may extend to the inner side of the cylinder body 121.

A refrigerant that has passed through the gas inlet 126 flows into the space between the inner side of the cylinder body 121 and the outer side of the piston body 131 through the cylinder nozzle 125. The refrigerant performs the function of a gas bearing for the piston 130 by providing a floating force to the piston.

Figure 5:
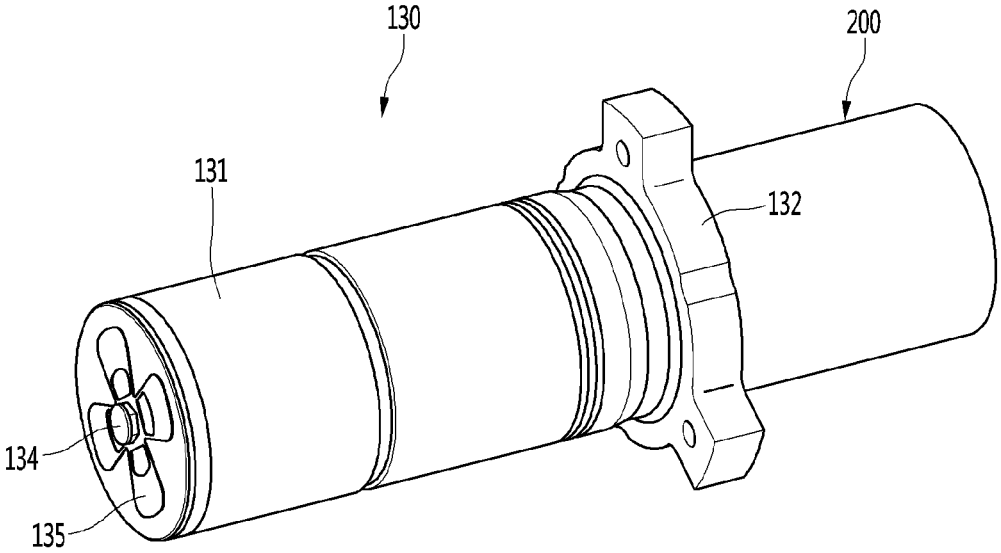
FIG. 5 is a view showing a piston and a muffler of a linear compressor according to a first embodiment of the present disclosure.
Figure 6:
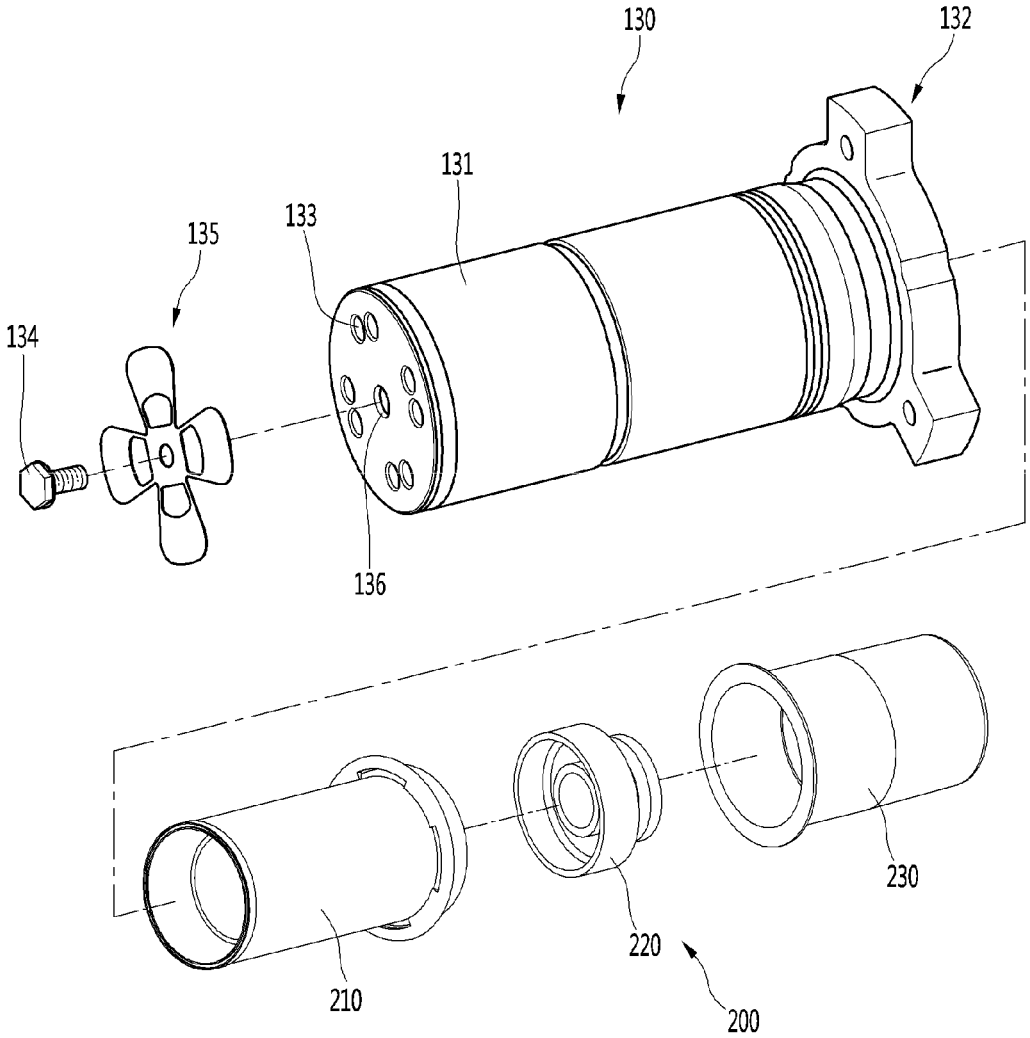
FIG. 6 is an exploded view showing the piston and the muffler of the linear compressor according to the first embodiment of the present disclosure.

FIG. 5 is a view showing a piston and a muffler of a compressor according to a first embodiment of the present disclosure and FIG. 6 is an exploded view showing the piston and the muffler of the compressor according to a first embodiment of the present disclosure.

As shown in FIGS. 5 and 6, the linear compressor according to an aspect of the present disclosure includes a piston 130 having a suction hole 133 for suctioning a refrigerant into a compression space P and a suction valve 135 disposed at a side of the piston 130 to open/close the suction hole 133. Also, the linear compressor further includes a valve coupling part 134 coupled to the piston 130 to couple the suction valve 135 to the piston 130.

Also, a coupling hole 135 to which the valve coupling member 134 is coupled is formed on the piston 130. The valve coupling member 134 is coupled to the coupling hole 136 through the suction valve 135. Accordingly, the center side of the suction valve 135 is fixed to the piston 130 by the valve coupling member 134.

Also, the edge of the suction valve 135 may open the suction hole 133 by bending forward. Also, the edge of the suction valve 135 may close the suction hole 133 by returning backward.

Such movement of the suction valve 135 is determined by pressure. That is, the suction hole 133 is opened when pressure is higher at the rear end than the front end of the suction valve 135, and the suction hole 133 is closed when pressure is higher at the front end than the rear end of the suction valve 135. When the suction valve 135 moves faster forward, more refrigerant can flow to the compression space P through the suction hole 133.

That is, when pressure at the rear end of the suction valve 133, that is, the pressure of the refrigerant accommodated in the piston 130 is high, more refrigerant can flow through the suction hole 133. The pressure of the refrigerant can be adjusted by the muffler 200 accommodated in the piston 130.

As shown in FIGS. 5 and 6, the linear compressor according to an aspect of the present invention includes a muffler 200. The muffler 200 may be composed of a plurality of components coupled to each other. For example, the muffler 200 may be composed of three components, and for the convenience of description, which are discriminated into a first muffler 210, a second muffler 220, and a third muffler 230 in the order shown in FIG. 6.

The first muffler 210 is disposed in the piston 130 and the second muffler 220 is coupled to the rear end of the first muffler 210. Also, the third muffler 230 accommodates the second muffler 220 and may extend rearward from the first muffler 210.

Also, a muffler filter (not shown) may be disposed at the interface between the first muffler 210 and the second muffler 220. For example, the muffler filter may have a circular shape and the outer side of the muffler filter can be supported between the first and second mufflers 210 and 220.

In terms of the flow direction of the refrigerant, the refrigerant suctioned through the suction pipe 104 can sequentially flow through the third muffler 230, the second muffler 220, and the first muffler 210. The flow noise of the refrigerant can be reduced and the pressure thereof can be increased in this process.

The second and third mufflers 220 and 230 may be understood as components connecting the first muffler 210 and the suction pipe 104. That is, the second and third mufflers 220 and 230 may be omitted as auxiliary components. Hereafter, the first muffler 210 is referred to as a muffler, for the convenience of description, and is described in detail.

Figure 7:
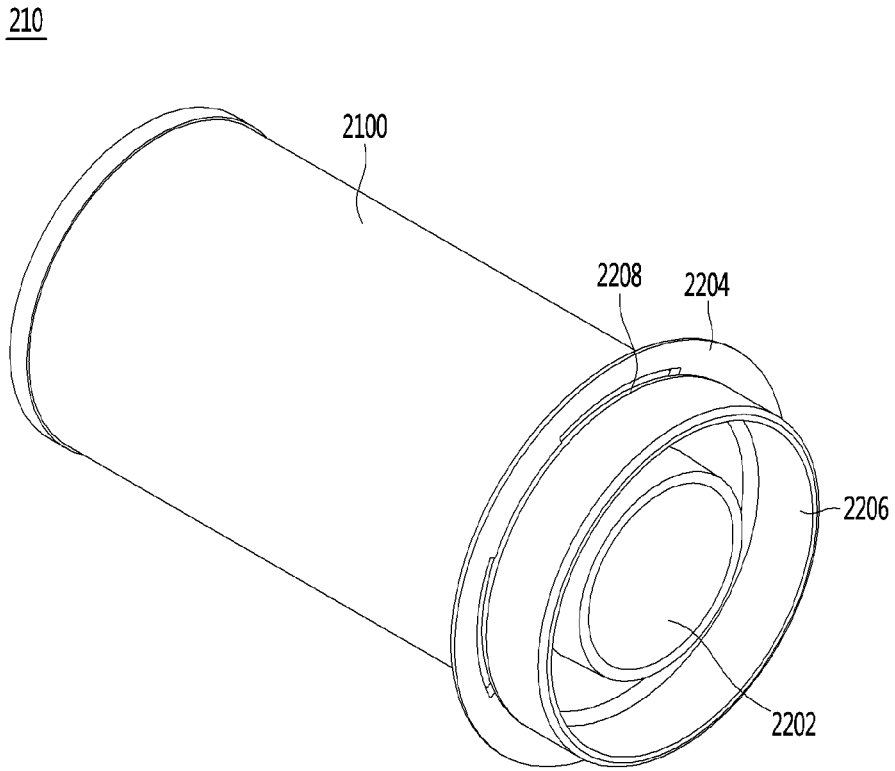
FIGS. 7 to 9 are views showing the muffler of the linear compressor according to the first embodiment of the present disclosure.
Figure 8:
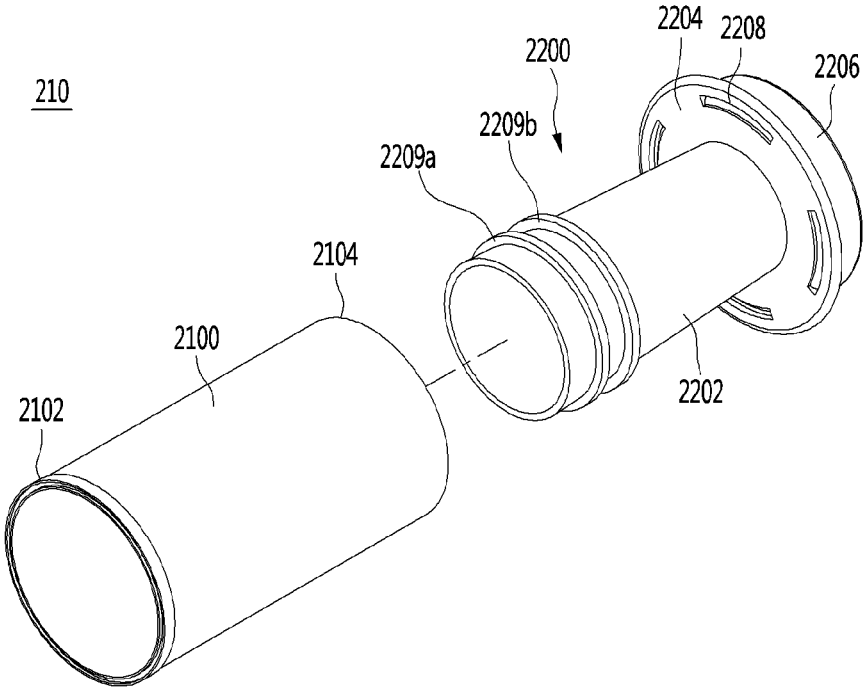
Figure 9:
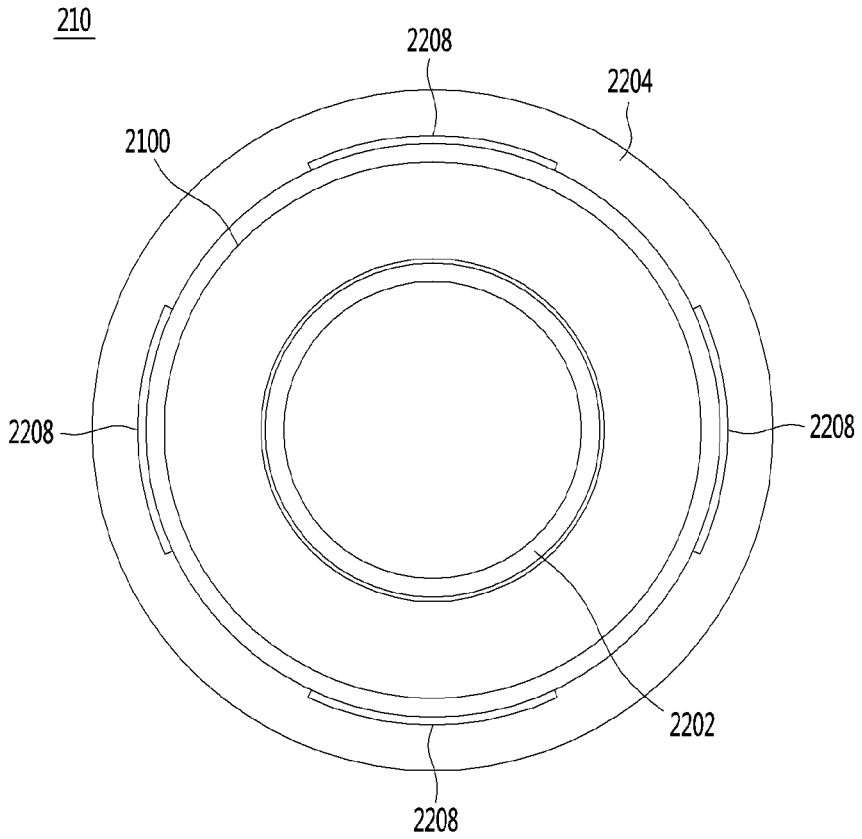

FIGS. 7 to 9 are views showing the muffler of the compressor according to the first embodiment of the present disclosure. In detail, FIG. 8 is an exploded view of the muffler 210 shown in FIG. 7 and FIG. 9 is a view showing the muffler 210 shown in FIG. 7 from a side.

As shown in FIGS. 7 and 8, the muffler 210 is divided into a muffler case 2100 and a muffler body 2200. The muffler case 2100 and the muffler body 2200 may be integrally formed with each other by a coupling member or a coupling method.

The muffler case 2100 is formed in a cylindrical shape axially extending and having both open ends. Both ends of the muffler case 2100 are discriminated into an axial front end 2102 and an axial rear end 2104. The axial front end 2102 and the axial rear end 2104 of the muffler case 2100 may be understood as a ring shape.

The muffler body 2200 includes a flow pipe 2202 axially extending. The flow pipe 2202 is a circular pipe elongated in the flow direction of a refrigerant. Also, both ends of the flow pipe 2202 are open.

The flow pipe 2202 is formed such that the outer diameter gradually increases in the flow direction of a refrigerant suctioned through the suction pipe 104 and flowing to the compression space P. That is, the axial front end of the flow pipe 2202 is wider than the axial rear end.

Also, the flow pipe 2202 is spaced radially inside the muffler case 2100. That is, the outer diameter of the flow pipe 2202 is smaller than the inner diameter of the muffler case 2100.

The flow pipe 2202 includes discs 2209*a* and 2209*b*. The discs 2209*a* and 2209*b* are disposed on the outer side of the flow pipe 2202 and may be positioned forward than a front-rear reference center Cl of the flow pipe 2202.

The discs 2209*a* and 2209*b* have a substantially ring shape, and the outer sides of the discs 2209*a* and 2209*b* may be spaced a predetermined gap (hereafter, a disc gap) apart from the inner side of the piston 130.

The discs 2209*a* and 2209*b* include a first disc 2209*a* and a second disc 2209*b* spaced rearward apart from the first disc 2209*a*.

The first disc 2209*a* discharges the muffler 210 to prevent the refrigerant flowing to the suction valve 135 from flowing into the space (hereafter, a case space) between the flow pipe 2202 and the muffler case 2110. If the refrigerant that is supposed to be suctioned into the compression space P through the suction valve 135 flows into the case space due to a pressure change, the refrigerant cannot be used for compression. That is, the case space functions as a dead zone region of a refrigerant, thereby being able to decrease suction efficiency.

To prevent this problem, the first disc 2209*a* is disposed ahead of the second disc 2209*b* and forms a small spacing distance (disc gap) from the inner side of the piston 130, thereby functioning as a "blocking wall" that prevents a refrigerant from flowing into the case space. That is, the first disc 2209*a* may press a refrigerant to the suction hole 133.

The second disc 2209*b* may be understood as a component for constituting a Helmholtz Resonator for reducing noise. The Helmholtz Resonator, which is a device absorbing sound by resonating fluid at a specific frequency, may form a chamber for reducing noise and a neck portion connected to the chamber at a side of the refrigerant channel.

Also, the muffler case 2100 axially extends further than the flow pipe 2202. In detail, the axial front end 2102 of the muffler case 2100 is positioned axially forward further than the flow pipe 2202.

Also, the muffler body 2200 includes a flow pipe coupling part 2204 and a flow pipe connecting part 2206.

The flow pipe coupling part 2204 may radially extend outward from the flow pipe 2202 and may be seat on an end of the piston 130. That is, the flow pipe coupling part 2204 is formed at a position corresponding to an end of the piston 130. A predetermined groove corresponding to the flow pipe coupling part 2204 may be disposed at the end of the piston 130.

The flow pipe coupling part 2204 radially extends further than the outer diameter of the muffler case 2100. That is, the flow pipe coupling part 2204 radially extends further than the muffler case 2100 outside the flow pipe 2202.

Also, the axial rear end of the muffler case 2100 is coupled to the flow pipe coupling part 2204. In other words, the muffle case 2100 may be understood as extending axially forward from the flow pipe coupling part 2204.

Also, a plurality of flow openings 2208 that is open is disposed in the flow pipe coupling part 2204. As shown in FIG. 9, the flow openings 2208 may be formed as arc-shaped holes circumferentially extending. Also, the flow openings 2208 are spaced circumferentially apart from each other.

The flow openings 2208 are formed radially outside the muffler case 2100. In detail, the flow openings 2208 are formed radially outside the axial rear end 2104 of the muffler case 2100. The flow openings 2208 correspond to openings through which the refrigerant in the shell 101 flows. They will be described in detail below.

The flow pipe connecting part 2206 extends rearward from the flow pipe coupling part 2204 further than the flow pipe 2202. The flow pipe connecting part 2206 may be in contact with an end of the second muffler 220. Also, the third muffler 230 is disposed outside the flow pipe connecting part 2206. That is, the flow pipe connecting part 2206 may be understood as a component for connection with the second and third mufflers 220 and 230.

Figure 10:
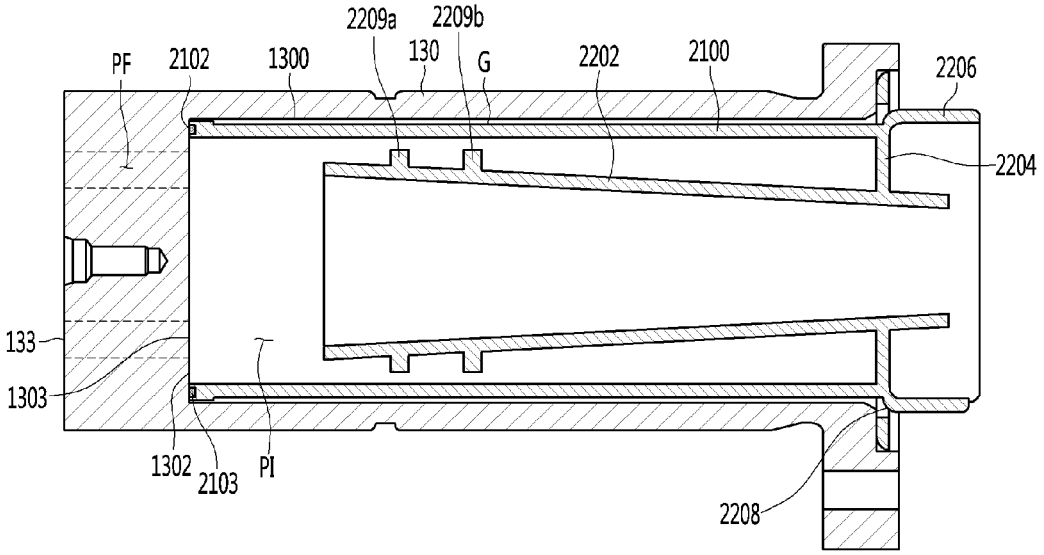
FIG. 10 is a view showing a cross-section of the piston and the muffler of the linear compressor according to the first embodiment of the present disclosure.

FIG. 10 is a view showing a cross-section of the piston and the muffler of the compressor according to the first embodiment of the present disclosure.

As shown in FIG. 10, an internal space PI in which the muffler 210 is inserted is formed in the piston 130. In detail, at least a portion of the muffler 210 is disposed in the internal space PI.

The internal space PI may be defined by the inner wall of the piston 130, that is, the first inner wall 1300 and the second inner wall 1302. That is, the internal space may be understood as a cylindrical shape entirely axially extending. Also, the first inner wall 1300 may configure the inner side wall of the piston 130 and the second inner wall 1302 may configured to the inner front wall of the piston 130.

The first inner wall 1300 may have a cylindrical shape. The second inner wall 1302 may have a circular shape.

Also, the axial rear portion of the internal space PI is provided as an opening in which the muffler 210 is inserted. Further, the axial rear portion of the internal space PI may be at least partially closed when the muffler 210 is inserted.

The muffler 210 is disposed in this case in contact with the inner wall of the piston 130 that forms the internal space PI. In particular, the muffler 210 is disposed in contact with the second inner wall 1302. In detail, the axial front end 2102 of the muffler case 2100 is positioned in close contact with the second inner wall 1302.

In this case, a sealing member 2103 preventing leakage of a refrigerant may be disposed between the axial front end 2102 of the muffler case 2100 and the inner wall 1302. That is, the muffler case 2103 is disposed in close contact with the second inner wall 1302 to prevent a refrigerant from flowing through the sealing member 2103.

Accordingly, it is possible to prevent the refrigerant that has flowed through the muffler 210 from flowing to the first inner wall 1300. Referring to FIG. 10, it can be seen that the refrigerant flowing along the muffler 210 cannot flow to the first inner wall 1300 by the muffler case 2100.

In this case, the axial front end 2102 of the muffler case 2100 is formed in a ring shape corresponding to the outer diameter of the second inner wall 1302. In detail, the axial front end 2102 of the muffler case 2100 may be provided slightly smaller than the outer diameter of the second inner wall 1302.

Also, it can be seen that the muffler case 2100 extends along the first inner wall 1300. In this case, the muffler case 2100 is spaced part from the first inner wall 1300. Accordingly, a predetermined gap is formed between the muffler case 2100 and the first inner wall 1300 and the gap forms a flow space G.

The flow space G may be understood as a portion of the internal space PI. In other words, the internal space PI may be divided into an inner space and an outer side in the radial direction of the muffler case 2100 by the muffler case 2100. Also, the flow space G corresponds to the space positioned radially outside the muffler case 2100.

In this case, the flow space G may communicate with the outside of the piston 130 by the flow openings 2208. Also, the refrigerant outside the piston 130, that is, inside the shell 101 flows through the flow openings 2208. The refrigerant in the shell 101 may correspond to a refrigerant at relatively low temperature and pressure.

Such as refrigerant can be sent into and discharged out of the flow space G in accordance with reciprocation of the piston 130. Accordingly, there is an effect that the temperature of the piston 130 decreases.

As a result, a refrigerant suctioned through the suction pipe 104 flows radially inside the muffler 210 inserted in the piston and a refrigerant in the shell 101 flows radially outside. Also, the internal space PI may be understood as being divided into two spaces in which refrigerants having different properties flow by the muffler case 2100.

Also, an inlet end 1303 of a suction channel PF communicating with the compression space P is formed in the second inner wall 1302. The suction channel PF may be understood as a passage formed through the piston 130. Also, the suction hole 133 may be formed at an outlet end of the suction channel Pf.

Accordingly, a refrigerant flowing through the muffler 210 may more stably flow to the suction channel PF by the muffler case 2100. As a result, the muffler case 2100 can reduce the temperature of the piston 130 and can guide flow of the suctioned refrigerant.

Figure 11:
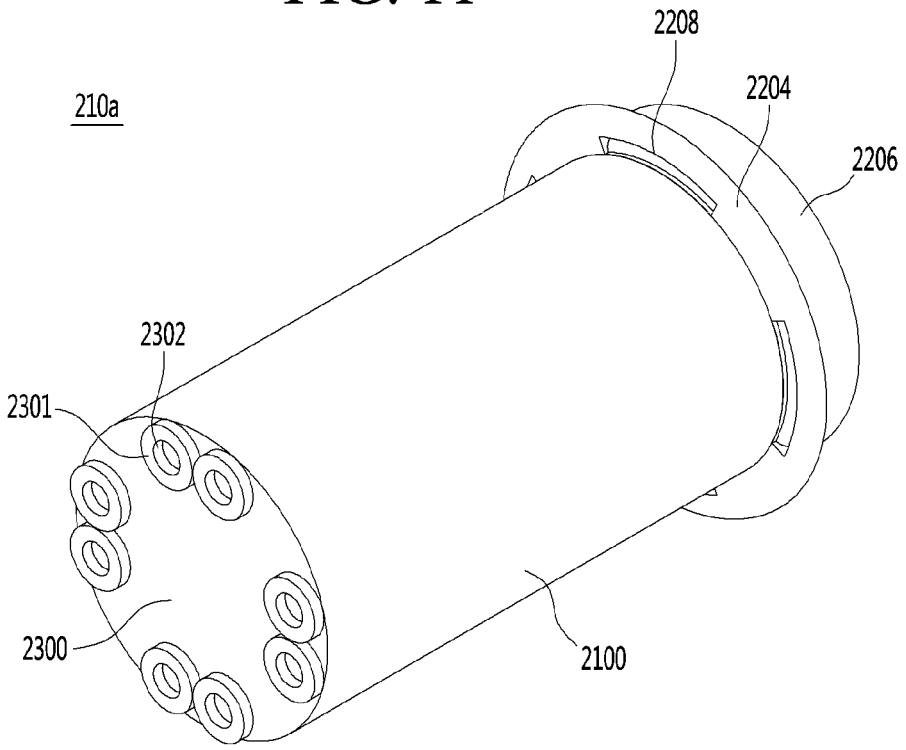
FIG. 11 is a view showing a muffler of a linear compressor according to a second embodiment of the present disclosure.
Figure 12:
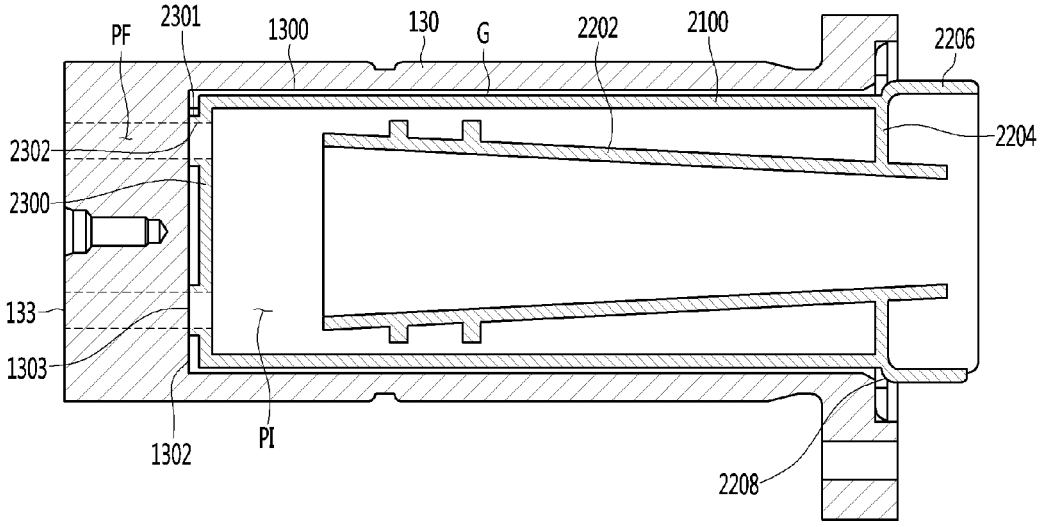
FIG. 12 is a view showing a cross-section of the piston and the muffler of the linear compressor according to the second embodiment of the present disclosure.

FIG. 11 is a view showing a muffler of a compressor according to a second embodiment of the present disclosure and FIG. 12 is a view showing a cross-section of the piston and the muffler of the compressor according to the second embodiment of the present disclosure.

A muffler **210*a* having a shape partially different from the muffler 210 described above is shown in FIGS. 11 and 12**. The same shape and configuration are given the same reference numerals and employ the above description, and are not described.

As shown in FIGS. 11 and 12, the muffler **210*a* includes a muffler case 2100 and a muffler body 2102. In this case, an axial front end 2300 of the muffler case 2100 may be formed in a ring shape corresponding to the second inner wall 1302. The front end of the muffler case 2100** may be closed haft without being open.

The muffler case 2100 includes a protrusion 2301 protruding forward from the axial front end 2300. The protrusion 2301 may come in contact with the inlet end 1303 of the piston 130.

A suction opening 2302 passing through the muffler case 2110 is formed at the protrusion 2301. The inside and the outside of the muffler case 2100 can communicate through the suction opening 2302.

That is, the suction opening 2302 is formed at the axial front end 2300 of the muffler case 2100 and may be formed at a position corresponding to the inlet end 1303 of the suction channel PF. Also, the intake opening 2302 may be provided in a number corresponding to the suction holes 133.

By this shape, a refrigerant flowing to the muffler 210 flows to the suction channel PF through the suction opening 2302. That is, the suctioned refrigerant can flow without coming in contact with the inner wall of the piston 130 except for the suction channel PF.

What is claimed is:

1. A linear compressor, comprising:

a shell;

a suction pipe connected to the shell and configured to supply refrigerant to an inside of the shell;

a cylinder that is disposed in the shell and that defines a compression space therein configured to receive the refrigerant;

a piston configured to reciprocate in the cylinder along an axial direction and configured to compress the refrigerant in the compression space; and a muffler configured to supply the refrigerant received through the suction pipe to the compression space, wherein the piston comprises an inner wall that defines an internal space that accommodates at least a portion of the muffler, and the muffler is in contact with the inner wall of the piston, and wherein the muffler partitions the internal space of the piston into:

a first space inside the muffler, the first space being configured to receive the refrigerant suctioned through the suction pipe, and a second space outside the muffler, the second space being configured to receive the refrigerant in the shell.

2. The linear compressor of claim 1, wherein the piston defines a suction channel that communicates the internal space of the piston with the compression space of the cylinder, and wherein the inner wall of the piston comprises:

a first inner wall that defines an inner circumferential surface of the piston; and a second inner wall that defines an inlet end of the suction channel and that is in contact with the muffler.

3. The linear compressor of claim 2, wherein the muffler has an axial front end that is in contact with the second inner wall, the axial front end being configured to block the refrigerant that is suctioned through the suction pipe and moves to the first inner wall.

4. The linear compressor of claim 3, wherein the axial front end of the muffler has a ring shape, and wherein an outer diameter of the axial front end of the muffler corresponds to a diameter of the second inner wall of the piston.

5. The linear compressor of claim 3, wherein the axial front end of the muffler has a circular plate shape facing the second inner wall of the piston, and defines a suction opening corresponding to the inlet end of the suction channel.

6. The linear compressor of claim 3, further comprising a sealing member that is disposed between the axial front end of the muffler and the second inner wall of the piston, the sealing member being configured to block leakage of the refrigerant.

7. The linear compressor of claim 2, wherein the muffler comprises a muffler case that extends along the first inner wall, the muffler case being configured to block the refrigerant that is suctioned through the suction pipe and that moves to the first inner wall.

8. The linear compressor of claim 7, wherein the muffler defines a flow opening that is configured to receive the refrigerant in the shell and to supply the refrigerant to a flow space defined between the muffler case and the first inner wall.

9. The linear compressor of claim 8, wherein the flow opening comprises a plurality of flow openings that are defined at an axial rear end of the muffler case and that are circumferentially arranged along an outside of the axial rear end of the muffler case.

10. The linear compressor of claim 1, wherein the internal space comprises a flow space defined between the muffler and the inner wall of the piston.

11. The linear compressor of claim 1, wherein the muffler comprises:

a first muffler that is disposed in the internal space, the first muffler comprising a muffler case that extends along the inner wall of the piston in the axial direction; and a second muffler and a third muffler that are coupled to the first muffler and that are disposed axially rearward relative to the piston.

12. The linear compressor of claim 11, wherein the first muffler comprises a flow pipe that is disposed radially inside the muffler case, that is spaced apart from the muffler case, and that extends in the axial direction.

13. The linear compressor of claim 12, wherein the muffler case further extends in the axial direction than the flow pipe and is in contact with the inner wall of the piston.

14. The linear compressor of claim 12, wherein an outer diameter of the flow pipe increases along a flow direction of refrigerant from the suction pipe toward the compression space.

15. A linear compressor comprising:

a shell;

a suction pipe connected to the shell and configured to supply refrigerant to an inside of the shell;

a cylinder that is disposed in the shell and that defines a compression space therein configured to receive the refrigerant;

a piston configured to reciprocate in the cylinder along an axial direction and configured to compress the refrigerant in the compression space; and a muffler configured to supply the refrigerant received through the suction pipe into the compression space, wherein the piston comprises an inner wall that defines an internal space that accommodates at least a portion of the muffler, wherein the muffler comprises a muffler case that extends along the inner wall, the muffler case being configured to block the refrigerant that is suctioned through the suction pipe and moves to the inner wall, and wherein the muffler partitions the internal space of the piston into:

a first space inside the muffler, the first space being configured to receive the refrigerant suctioned through the suction pipe, and a second space outside the muffler, the second space being configured to receive the refrigerant in the shell.

16. The linear compressor of claim 15, wherein the internal space comprises a flow space defined between the muffler case and the inner wall of the piston.

17. The linear compressor of claim 15, wherein the muffler further comprises a flow pipe that is disposed radially inside the muffler case, that is spaced apart from the muffler case, and that is configured to guide the refrigerant suctioned through the suction pipe.

18. The linear compressor of claim 15, wherein the muffler case divides the internal space of the piston into two spaces that are configured to carry refrigerants having different properties, respectively.

* * * * *